United States Patent [19]

Barker et al.

[11] Patent Number: 4,543,760

[45] Date of Patent: Oct. 1, 1985

[54] ATTACHMENT CLIP UNIT FOR STANDING SEAM ROOF

[75] Inventors: W. David Barker; Raymond K. Heisey, Jr., both of Kansas City; Arturo C. Mariano, Independence, all of Mo.

[73] Assignee: Butler Manufacturing Company, Kansas City, Mo.

[21] Appl. No.: 556,194

[22] Filed: Nov. 29, 1983

[51] Int. Cl.[4] ..... E04D 1/34

[52] U.S. Cl. ..... 52/544; 52/545; 52/573; 52/713

[58] Field of Search ..... 52/544, 545, 550, 551, 52/573, 478, 713, 712, 520; 428/542.8

[56] References Cited

U.S. PATENT DOCUMENTS

| | | | |
|---|---|---|---|
| 3,727,358 | 4/1973 | Howell | 52/712 X |
| 4,034,532 | 7/1977 | Reinwall, jr. | 52/573 X |
| 4,193,247 | 3/1980 | Heckelsberg | 52/544 X |
| 4,361,998 | 12/1982 | Ellison et al. | 52/544 X |

OTHER PUBLICATIONS

Published PCT Application No. WO84/00393, Feb. 2, 1984, Johansson.

*Primary Examiner*—Carl D. Friedman

*Attorney, Agent, or Firm*—Shoemaker and Mattare, Ltd.

[57] ABSTRACT

A clip unit for attaching a standing seam roof to a building structural element includes a base with a cross-piece mounted thereon. A one-piece tab is slidably mounted on the cross-piece and is interfolded into the standing seam used to attach two roof panels together to attach those panels to the clip unit. The base is attached to a building structural element, such as a purlin, or the like, so that the roof panels are attached to that structural element in a manner which permits thermally induced panel movement to be accommodated. Another embodiment has a tab integral with a base which has a rod therewith which rod in turn is slidable along an eyebolt which is attached to a building structural element.

26 Claims, 25 Drawing Figures

ATTACHMENT CLIP UNIT FOR STANDING SEAM ROOF

BACKGROUND OF THE INVENTION

The present invention relates, in general, to building roofs, and, more particularly, to means for attaching roof panels to building structural members.

Butler Manufacturing Company markets roofs for buildings under the trademarks MR-24 and CMR-24. These roofs include a multiplicity of panels which are seamed together and attached to the building structural elements in a manner which permits movement of those panels to accommodate thermal expansion and contraction.

There are clip units for attaching these panels to the building structural elements such as the roof purlins or the like.

Even though effective, these known clip units have several disadvantages. For example, in a unit including a tab positioned in a slot, the tab may be susceptible to frictional wear by contact with the slot edges, and might, under some circumstances, be threaded out of the slot. Furthermore, this tab might become uncentered during panel installation.

A further drawback to some known units is that the tab can "unfold" and thread out through a slot in the clip base since one end is unattached.

SUMMARY OF THE INVENTION

The clip unit embodying the present invention includes a one-piece base attached to a building structural element, a cross-piece attached to the base, and a one-piece tab attached to the cross-piece. A sleeve, snap-on clip, or tape is mounted on the cross-piece to maintain the tab in the desired center position on that cross-piece.

The tab is attached to the base by looping that tab around the cross-piece which is mounted on the base. Spot welding, a locking projection, or bendable side extensions hold the looped tab together. The tab connects the panel to the base and has both ends thereof secured to the panel seam. The tab is preferably made from stainless steel, thereby allowing the tab to be much thinner than if that tab were made from galvanized steel, or the like, thus promoting long life for the seaming machine, and also providing for a much tighter seam. Stainless steel provides desired qualities of strength, low heat transfer characteristics and non-corrosiveness to a critical link between the panel and the structural elements.

The tab is attached to the base by looping that tab around the cross-piece and the cross-piece, being smooth and either oblong or triangular, provides an excellent sliding surface for the looped tab. The cross-piece is located adjacent to the upper portion of the clip base near the panels, thereby providing maximum slidability for the tab. A positive, factory applied centering structure for the tab for use during the initial installation of the clip unit is located on the cross-piece and thus the tab will not be dislodged during normal shipping or handling.

Thus, the clip unit is compact, efficient and effective in design and does not include any unnecessary bulk because of the use of stiffening ribs and flanges in the clip base, while remaining effective in resisting wind uplift and foot traffic loads while providing full panel support. The clip unit provides full panel retention and support yet has minimum contact between the panel and the clip for reduced heat transfer. The top of the clip unit base has aprons which provide full panel support and include rounded corners. Prior clip units gave only partial support and had sheared edges which could conceivably damage the panel.

The centering structure includes a loose or heat shrinkable plastic sleeve that holds the tab in position but is frangible and destructible and will allow the tab to move as the roof moves after installation. Another embodiment uses spaced wrapped tape for the centering structure. Snap-on clips provide a preferred embodiment, the important concept being that the centering structure will hold the tab centered and in proper position for initial installation of the panels over the clip unit, but will break under moderate loads to permit shifting of the panel locked tab thereafter during thermal stresses and expansion of the combined elements.

The tab is an effective, efficient design having a one-piece unitary body looped around the cross-piece and having both ends of the tab fixed in the seam. The tab has a cross-over configuration which eliminates a need for a double thickness element in the roof seam. Spot-welding between the cross-over portions positively secures the tab together, or side extensions or mechanical stitching may be provided for the same purpose.

The base and cross-piece of the unit provide full panel support and modularity of installation. The crosspiece is preferably triangular, but can also be oblong in shape for more effective strength. The triangular shape keeps the tab properly oriented and permits easy slidability thereof. The cross-piece can be lubricated to further promote tab slidability, or a coating of Teflon can be applied over the cross-piece.

OBJECTS OF THE INVENTION

It is a main object of the present invention to attach roof panels to a building structural element in a manner which does not endanger those roof panels.

It is another object of the present invention to attach roof panels to a building structural element in a strong, secure manner.

It is a further object of the present invention to attach roof panels to a building structural element in a manner which maintains the attaching structure in proper orientation during panel installation, and also provides support of abutting halfs of adjoining roof panels.

It is still another object of the present invention to attach roof panels to a building structural element in a manner which facilitates slidability of a tab connecting the panels to a base of a clip unit so that thermal expansion of the panels relative to the supporting roof purlins can occur without damage to the panels or roofing support structure.

It is yet a further object of the present invention to attach roof panels to a building structural element in a manner which reduces the possibility of creating a wedging action of a tab rather than a sliding action of that tab on a cross-piece of a clip unit.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
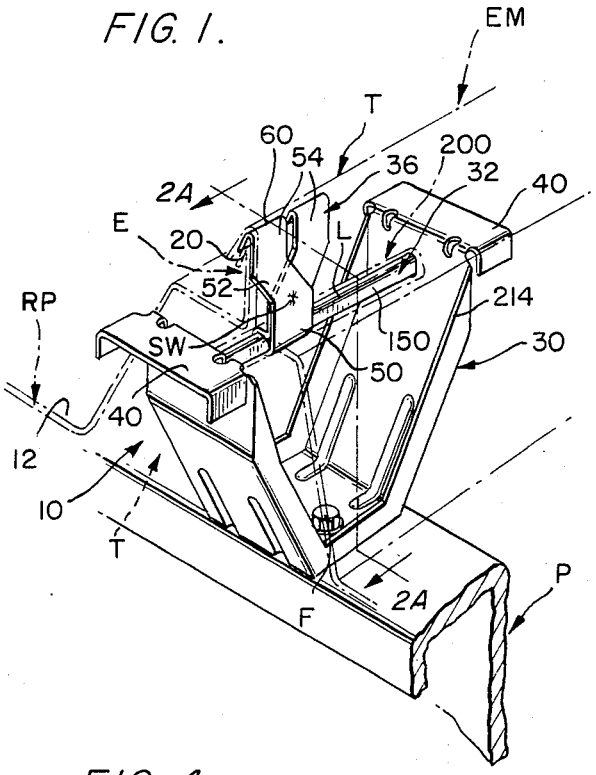
FIG. 1 is a perspective view of a first form of the clip unit embodying the teachings of the present invention.
Figure 2A:
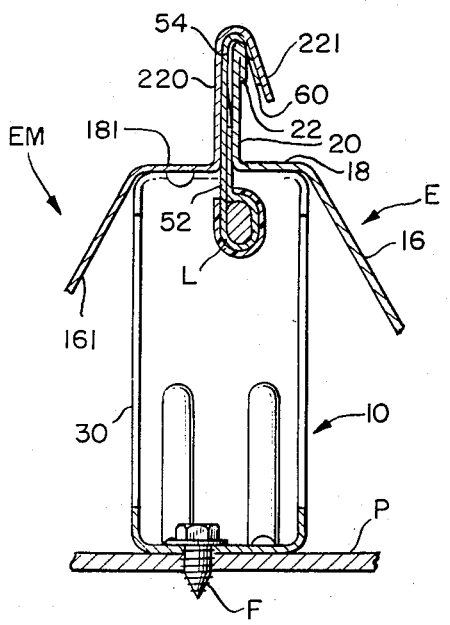
FIG. 2A is a cross-sectional view taken along line 2—2 of FIG. 1.

Shown in FIG. 1 is a clip unit 10 coupling roof panels RP to a building structural element such as purlin P, or the like. The roof panels are coupled together at the edges E and EM thereof by crimping those edges together to form standing seams. The panels are preferably those panels manufactured by Butler Manufacturing Company under the trademark MR-24 and the trademark CMR-24, and include a central portion 12 and edge portions E and EM. As best shown in FIG. 2A, the edge portion E includes a first section 16 which is upwardly diverging with respect to the central portion 12 and a shoulder portion 18 which is essentially parallel with respect to the central portion. A flange 20 extends upwardly from the shoulder to be essentially perpendicular with respect to the central portion. A closed hook portion 22 is bent back over the flange 20. Of course, once the joint seam is finished, the hook portion 22 is bent back again over the flange 20 (i.e., double-lock seamed, see FIG. 2B).

Each panel has two edges with the flange and hook on one edge being longer than the flange and hook on the other edge so that one edge of one panel can be mated with another edge of another panel. For example, the edge EM has an upwardly diverging section 161 with respect to the central portion 12 and a shoulder portion 181 which is essentially parallel to the central portion 12. A flange 220 extends upwardly from the shoulder 181 and has an open hook portion 221. The closure mating is performed by rolling the edges together to form a double lock seam (see FIG. 2B). A complete disclosure of the method of forming the panel seaming operation is contained in the brochure THE ROOF RUNNER TM - "SO IT SEAMS", Form No. 2889-3-69, Butler Manufacturing Company. The roof runner is the preferred means of forming the seam. The disclosures of THE ROOF RUNNER TM brochure and of LANDMARK TM BUILDINGS - ERECTION INFORMATION, Form No. 3032-BPS-5-73, Butler Manufacturing Company, are fully incorporated hereinto by reference thereto, as is the disclosure of THE BUTLER MR-24 ® ROOF SYSTEM, Form No. 3457-AC-3-73, Butler Manufacturing Company.

The panels RP attach to the purlins P by use of the clip and tab arrangement disclosed herein. Each clip has a tab that is free to move relative to the base. The clip unit base attaches to the purlin and the tab locks into the standing seam at the panel lap so that there is no penetration of the roof panels. This arrangement enables the roof to "float" on the structurals, compensating for expansion and contraction regardless of the severity of temperature changes.

The clip unit 10 includes a yoke-shaped base 30 having a cross-piece 32 attached thereto to span the base. A tab 36 is attached to the cross-piece and extends upwardly therefrom. Aprons 40 extend outwardly from the base and support roof panel shoulder sections 18 and 181 thereon as best shown in FIG. 1 and FIG. 2A. A fastener F attaches the base 30 to the purlin P.

Figure 4:
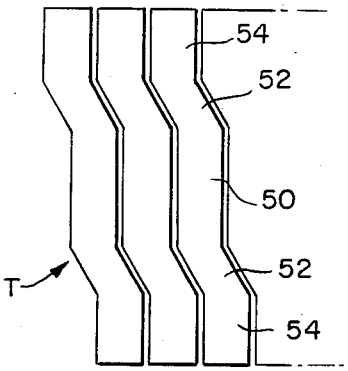
FIG. 4 is a plan view of a plurality of tabs as punched or cut from a piece of non-corrosive material, such as stainless steel, for use in the clip unit embodying the teachings of the present invention.

A plurality of tabs as stamped from a metal blank are shown in FIG. 4. Each tab T is continuous, unitary and one-piece and includes a center section 50 and a pair of first sections 52 which are parallel with each other and angled with respect to the center section 50. A pair of tongue portions 54 are parallel with each other and with the center section, but are oppositely offset from that center section.

A tab T is slidably attached to a cross-piece 32 as shown in FIG. 1, with the center section 50 bent to encircle that cross-piece so that opposite ends of the center section are superposed with each other. The offset nature of the first sections 52 causes those sections to cross over each other and to be outwardly diverging with respect to the center section. A spot weld SW holds sections 52 together as shown. The offset nature of the tongue sections 54 causes those sections to be essentially parallel with each other but spaced from each other and to extend upwardly from the cross-piece. Oil, grease, or Teflon particles to provide lubrication L can be placed between the tab and the cross-piece (i.e., either on the tab, the cross-piece, or both) to increase the ease of slidability of the tab on the cross-piece, if so desired. However, normally such lubrication is not needed.

Figure 2B:
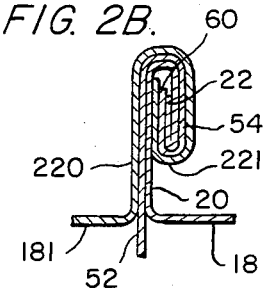
FIG. 2B is a fragmentary portion of FIG. 2A after panel seaming showing the double seaming joint of the tab and roof panels.

An end portion 60 of each tongue 54 is formed into a hook along with the panel portions 22, 221. As best shown in FIGS. 1, 2A and 2B, the tab end portions are interleaved with the mated panel edges. By being thus interleaved, the tabs will be rolled into the panel edge joining seam to thereby movably lock the panel to the purlins via the clip 10. As clearly shown in the figures, both ends of the tab are attached to the panel, thereby insuring great stability to the connection between the panels and the clip unit.

Figure 3:
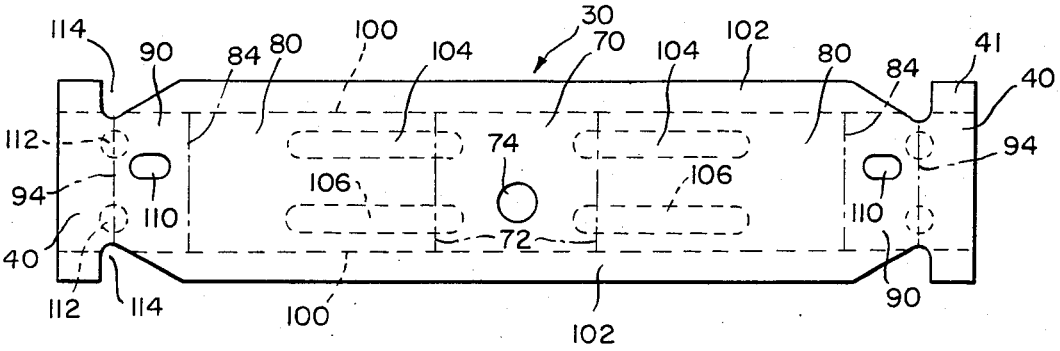
FIG. 3 is a plan view of a blank before forming for the base portion of the first form of the clip unit embodying the teachings of the present invention.

The blank for the base 30 is best shown in FIG. 3. The base blank is one continuous metal piece and includes a center portion 70 defined by two breaklines 72 and having a fastener accommodating hole 74 defined therein. A pair of wing sections 80 are defined by breaklines 72 and 84 and a pair of end sections 90 are defined by breaklines 84 and 94. The pair of aprons 40 have one end free and the other end defined by the breaklines 94.

Longitudinal breaklines 100 extend for essentially the entire length of the base blank and define flanges 102. Portions for elongated reinforcing ribs 104 and 106 are defined in the center and wing portions and elongate slots 110 are defined in the end portions. Circular reinforcing ribs 112 are defined in the apron and end sections and elongate notches 114 are defined in the flanges to have an arcuate portion in the apron and end sections.

The base blank is folded and formed along the breaklines to define the yoke-shaped base 30 having the aprons 40 substantially co-planar with each other and the slots 110 aligned with each other, as shown in FIG. 1. During the forming process the flange portions 41 of the apron are folded downwardly toward the center portion 70 and the flanges 102 on the rest of the base are folded upwardly away from the center 70. The downwardly folded flange portion 41 together with a 5° to 10° taper of the aprons 40 prevent damage to the panels which are supported on the clip. The height of the base from the aprons to the bottom center corresponds to the height of tunnel T defined by mating panel edges as measured from the panel edge shoulders 18 and 181 to the panel central portion 12 and/or top of the purlin so that the aprons are located immediately subjacent the panel shoulders to support the panels via those shoulders when a fastener couples the base to a purlin.

Figure 11:
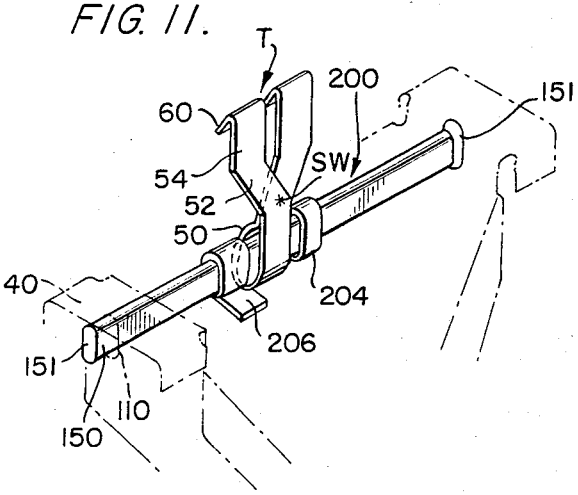
FIG. 11 is a perspective view showing a frangible tape centering structure on the first form of the clip unit embodying the teachings of the present invention.

As best shown in FIGS. 1 and 11, the cross-piece in the clip unit 10 includes a headless elongate body 150 which is oblong in transverse cross-sectional shape. Of course, a round or circular shaped cross-piece could be used instead of an oblong one. The cross-piece body is slidably received through the aligned slots 110. Both ends of the cross-piece are "upset" or swaged 151 after being received through the slots 110 to lock the cross-piece immovably in place.

Figure 5:
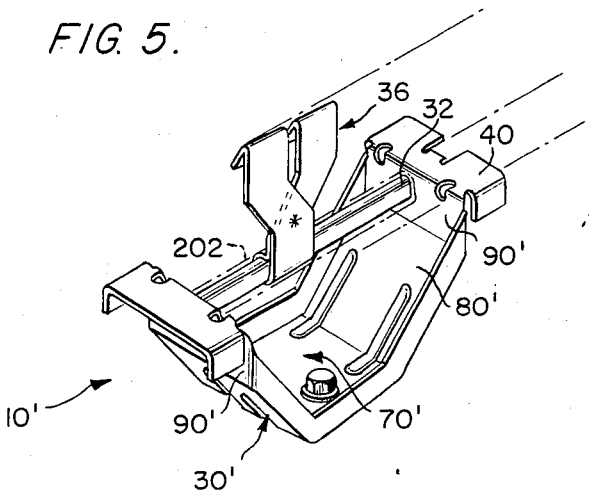
FIG. 5 is a perspective view of a second form of the clip unit which is of lesser height than the first form of FIG. 1.
Figure 5A:
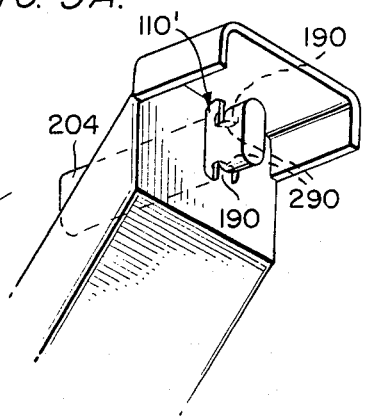
FIG. 5A shows retainer flanges on the clip.
Figure 6:
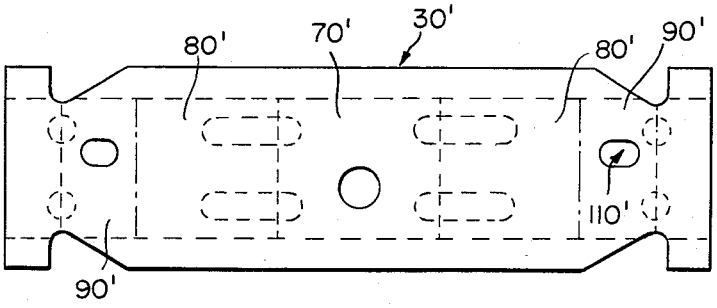
FIG. 6 is a plan view of a blank before forming for the base portion of the second form of the clip unit embodying the teachings of the present invention.

As an alternative, a retainer flange 190 (FIG. 5A) can be formed in end sections 90' adjacent the top and bottom of slots 110'. These flanges 190 engage and are in contact with slots 290 in the cross-piece 204 to lock the cross-piece into place in the slots 110'.

Tab centering structure 200 (FIG. 11) includes a pair of sleeve portions 204 and 206 comprising plastic tape wrapped around the cross-piece on either side of the tab to maintain the tab in the desired position on the cross-piece. The sleeve portions each have an end in abutting relationship with the tabs when in place on the cross-piece to hold the tab centered.

The pair of tape sleeves 204, 206 are frangible and expendable and merely maintain the tab in the desired position, preferably centered, on the cross-piece during the initial installation, i.e., panel handling, mounting and seaming operations. Being fracturable, the sleeves do not interfere with desired roof panel movement caused by thermal expansion and contraction after the roof is attached to the building structural elements. The sleeve merely maintains the proper tab position on the clip unit during the initial panel mounting and installation operations.

Clip unit 10' of the second embodiment is shown in FIGS. 5–8 and is identical to clip unit 10 except that unit 10' includes base 30' which is slightly more squat with respect to base 30 of unit 10. The base 30' includes a center portion 70' which is similar to center portion 70, and a pair of wing sections 80' which are similar to, but shorter than, wing portions 80 of unit 10. Base 30' includes end sections 90' which are similar to end sections 90, and aprons 40' with flange portions 41'. However, the overall height ($2\frac{1}{8}$") of base 30' is less than the height (35/16") of base 30. The unit 10' is formed by metal working a blank shown in FIG. 6 in the same manner as the blank of FIG. 3 for the first embodiment. While only two sizes of clips are depicted, the present invention can be employed in clips of various heights and sizes. Also, while not shown, the clips can be mounted on and with insulation panels of foam and the like, and spacer blocks may also be used.

Figure 7:
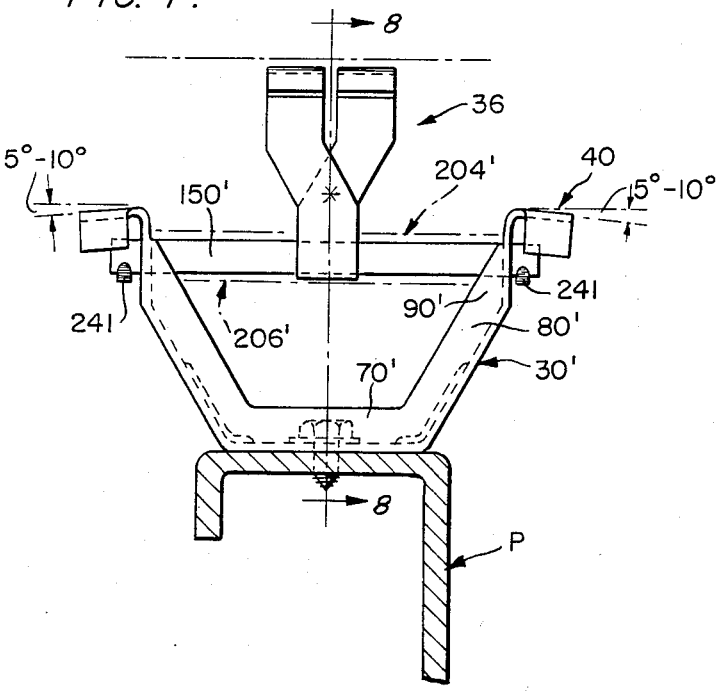
FIG. 7 is a side elevational view of the second form of the clip unit embodying the teachings of the present invention.
Figure 21:
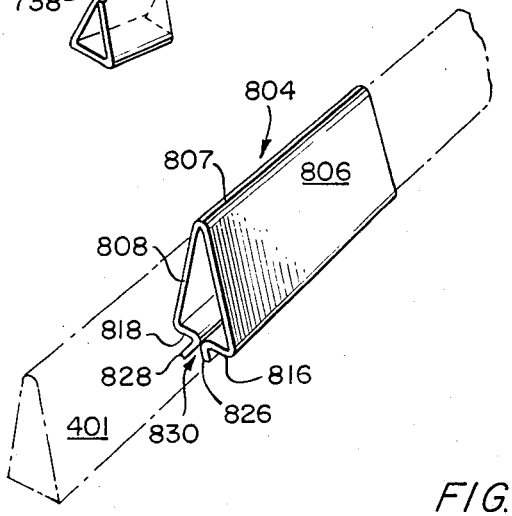
FIG. 21 is a perspective view of a snap-on centering clip per se.

FIG. 7 shows the 5° to 10° slope from a horizontal plane of the roof panel supporting aprons 40. Also, the swaged portions 241 of the cross-piece 150' can clearly be seen. Centering tapes 204' and 206' are also indicated by dotted lines. However, a sleeve as described below for FIG. 17, or clips as shown in FIG. 21, can be used for the centering structure. Polystyrene material has been found suitable for the sleeves and clips.

Figure 8:
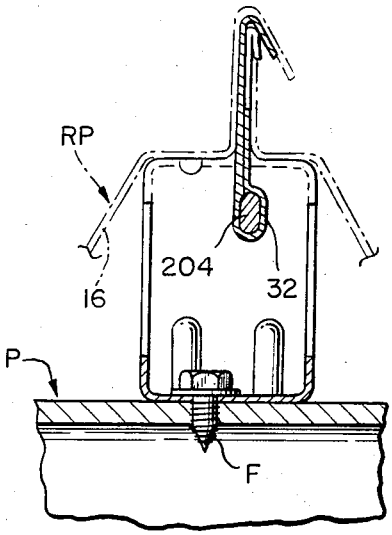
FIG. 8 is a cross-sectional view taken along line 8—8 of FIG. 7.

FIG. 8 shows the cross-piece 204 being of oblong cross-section. However, a cross-piece of triangular crosssection with complementary slots 110' of similar configuration (like FIGS. 12–16) can also be used if desired.

Figure 9:
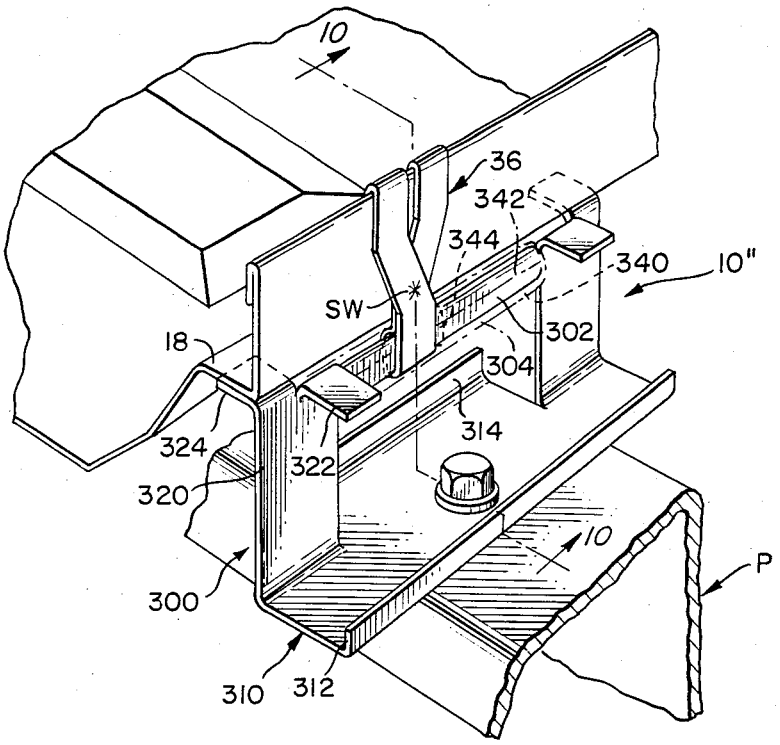
FIG. 9 is a perspective view of a third form of the clip unit with a centering structure being shown in phantom lines.
Figure 10:
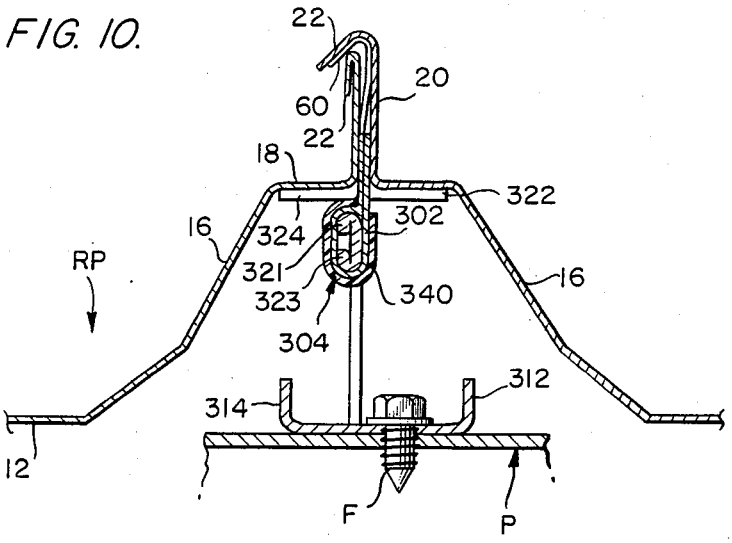
FIG. 10 is a cross-sectional view taken along line 10—10 of FIG. 9 with an overlapping roof panel added.

Shown in FIGS. 9 and 10 is yet another embodiment (third) of the clip unit embodying the present invention. The clip unit 10" is of unitary construction and includes a base 300 with a cross-piece 302 integrally attached thereto. The tab 36 of unit 10" is similar to tab 36 of units 10 and 10', and will not be further discussed. A tab centering structure 304 is also included in unit 10" which can be a sleeve like that of FIG. 17, or clips like in FIGS. 13 and 21, or tape as in FIG. 11.

The base 300 is I-shaped and includes a U-shaped foot 310 having a flange 312 on one portion thereof and a flange 314 on another portion thereof. A fastener attaches the foot to a purlin, or the like. Two upstanding legs 320 have apron flanges 322 and 324 on the upper ends thereof. The flanges support the panel shoulder portions 18 as above discussed.

The cross-piece 302 is unitary with the clip unit and integrally mounted on the base in the position of the cross-pieces of the units 10 and 10' so that tab 36 is positioned exactly as in the units 10 and 10' to be interleaved into the panel seams and thereby to attach the panels to the purlin, or other building structural element as above discussed.

As best shown in FIG. 10, the cross-piece 302 is rebent at the upper 321 and lower 323 portions thereof to assume an oblong shape similar to that of the cross-piece 32. Such shape is best suited for cooperating with the tab 36 encircling such cross-piece. However, other cross-sectional shapes can be used for the cross-pieces and tabs without departing from the scope of this disclosure.

The centering means 304 includes a sleeve 340 which is split longitudinally thereof at 342 (FIG. 9) so it can be positioned on the cross-piece 302 which is integral with the base 300. Slots 344 are also defined in the sleeve to accommodate the tab. The sleeve 340 functions and operates the same as the centering tapes 204, 206 of FIG. 1, and also the sleeve as described in FIGS. 17 and 21, and thus will not be further discussed.

Figure 12:
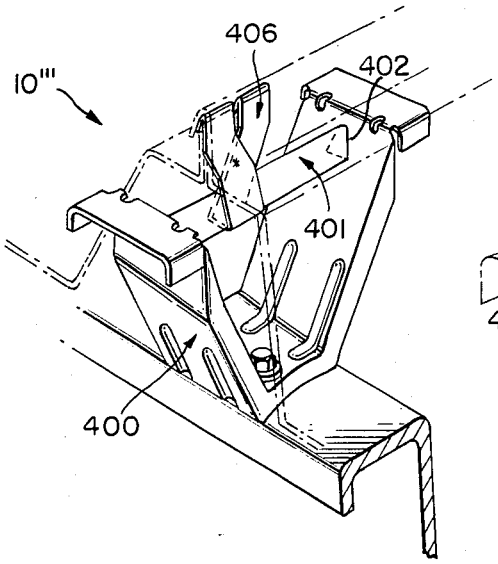
FIG. 12 is a perspective view of a fourth preferred form of the clip unit using a cross-piece of triangular configuration in cross-section.
Figure 19:
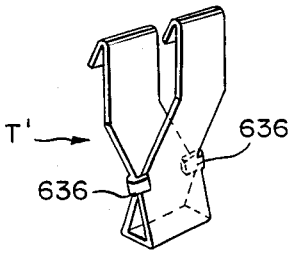
FIG. 19 is a perspective view of a tab from the tab supply blank of FIG. 18 as formed into shape ready for use.

A fourth embodiment of the clip unit embodying the present invention is shown in FIGS. 12–16, and is similar to the above-discussed units, except that the FIG. 12 unit 10''' includes a cross-piece 401 which is triangular in cross-sectional shape. The triangular cross-piece is received in triangular holes 402 in yoke 404, and the tab 406, folded about the cross-piece, assumes a triangular configuration 408 at one portion thereof. A spot weld SW can be used to secure the sections 452 together, or extensions or mechanical stitching like in FIGS. 19 and 20 can be used.

The triangular cross-piece 401 (FIG. 13) can be in the form of an isoceles triangle with equal legs 412 and 414 and a base 416. Of course, other triangular forms are also possible without departing from the scope of the present invention.

Figure 23:
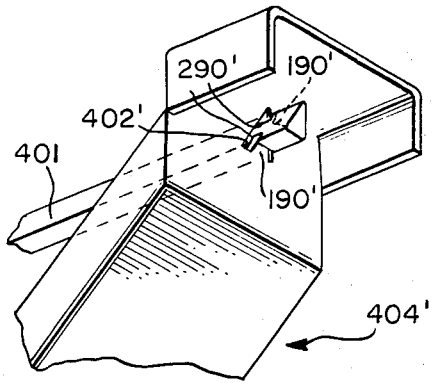
FIG. 23 is a perspective of another clip with retainer flanges.

In one form of the unit 400 (FIG. 13), one of the legs 412 or 414 is secured, as by welding 419, or the like, in the yoke. There are several ways for securing the cross-piece in the yoke. For example, the cross-piece can be upset or swaged after it is inserted (FIG. 11), or, since the cross-piece has a triangular shape, the corners can be struck and a portion of the material bent as necessary, in the manner 241 of FIG. 7. FIG. 23 shows an alternative of the FIGS. 12–16 embodiment having cross-piece 401 and retainer flanges 190' These retainer flanges 190' at the top and bottom of slots 402 complement and mate with slots 290' to retain the cross-piece locked in position with the clip, much in the manner of the teaching in FIG. 5A.

Figure 16:
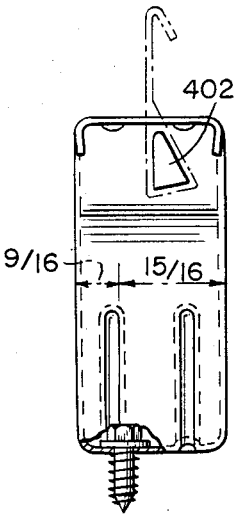
FIG. 16 is an end view looking from the right of FIG. 15 showing the yoke per se.

The unit 400 includes a hole 420, which, like the holes discussed in the above embodiments, such as hole 74 of FIG. 3, is defined to be off-center to allow for fastener F driving tool clearance. The triangular cross-piece is also offset to allow clearance for installation and to keep the panels properly oriented. FIG. 16 shows the preferred spacing of the hole centerline as being 9/16" from the closest edge.

Figure 15:
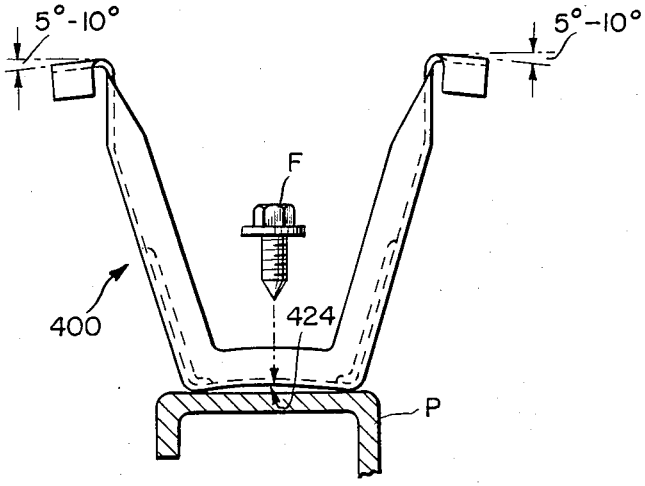
FIG. 15 is a side elevation of a yoke used in the fourth form of the clip unit embodying the teachings of the present invention.

The bottom of the yoke in all embodiments can be curved slightly upward, as shown by 424 in FIG. 15, so that when installed, the yoke is snugly positioned without rocking on burrs or the like which may be in the purlin P or clip hole.

Figure 17:
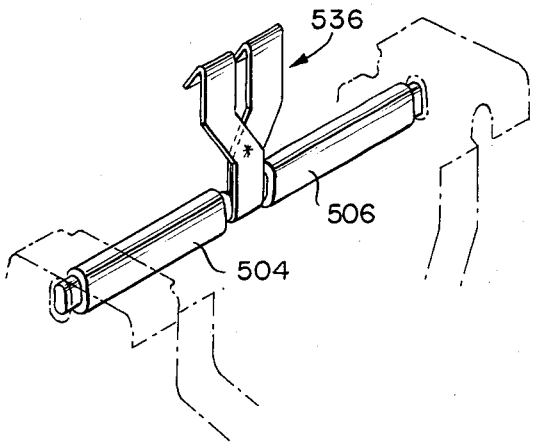
FIG. 17 is a perspective view of an oblong cross-piece with frangible sleeve-type centering structure for the tab.

FIG. 17 shows a pair of sleeve portions 504 and 506 which can be used with either the oblong shaped cross-piece, or a triangular shaped cross-piece. Again, these sleeves are made of frangible plastic material so that they can be destroyed during roof panel movement under thermal stresses as held by the tab 536 after the initial centering function during original installation.

Figure 18:
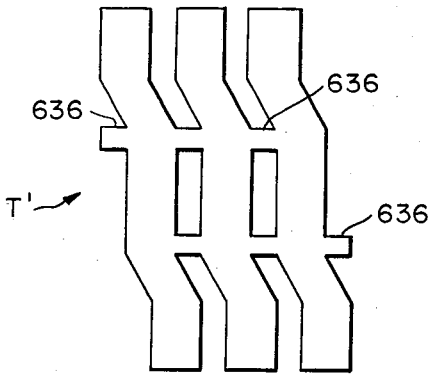
FIG. 18 is a plan view of a plurality of tabs having holding side extensions for use with the clip unit embodying the teachings of the present invention.

FIG. 18 shows an embodiment of tabs T' which are modified from those depicted in the embodiment of FIG. 4. In the embodiment of FIG. 4, the tabs are secured by spot welding SW, or the like. However, with the FIG. 18 embodiment, as shown in perspective in FIG. 19, the side extensions 636 as provided during the blanking, punching and cutting of the individual tabs can be used to secure the folded tab.

Figure 20:
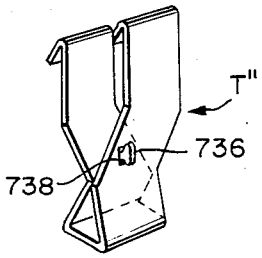
FIG. 20 is an alternative embodiment of the tab with a mechanical stitch instead of two side extensions.

FIG. 20 shows another embodiment of tab structure T'' having a single keyed projection or extension 736 appropriately inserted through an aperture 738 for holding the folded tab in place, i.e., mechanical stitching.

Figure 13:
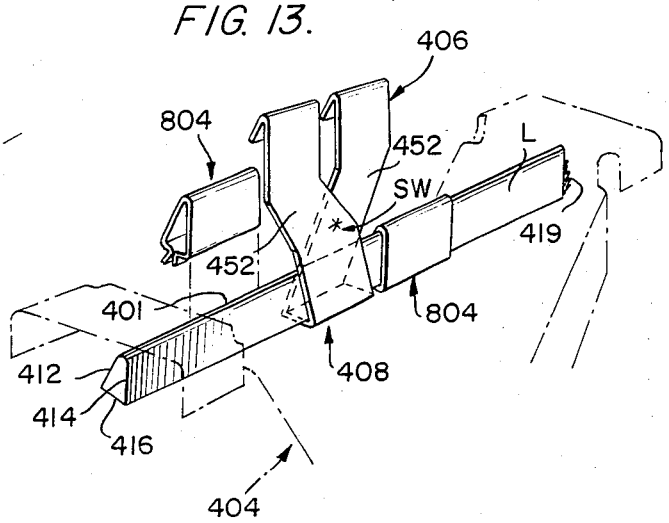
FIG. 13 is a fragmentary perspective view of the FIG. 12 triangular cross-piece with tab and centering sleeve mounted thereon.
Figure 14:
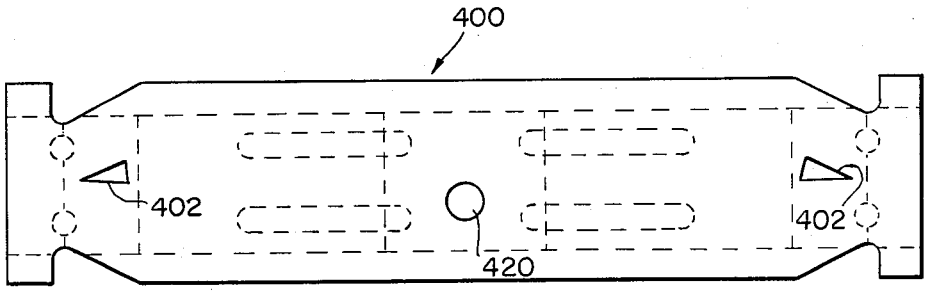
FIG. 14 is a plan view of a blank before forming for the base portion of the fourth form of the clip unit embodying the teachings of the present invention.

FIG. 21 shows in enlarged detail the FIG. 13 embodiment of the fracturable centering structure comprising the snap-on clip 804. A triangular cross-piece 401 has mounted thereon a fracturable centering structure 804. A side 806 is secured to another side 808 by a connecting hinge 807. Inwardly turned flanges 816 and 818 extend from the lower edges of sides 806 and 808, respectively, and have outwardly diverging edges 826 and 828. Between the diverging edges 826 and 828 a slight gap 830 will exist. Thus, after the appropriate tab T, T' or T'' has been mounted on the triangular cross-piece, a centering clip 804 can be positioned on either side thereof. Preferably, the clips 804 are made of plastic material (polystyrene) which is semi-flexible to permit the sides 806 and 808 to move outwardly along the connecting hinge 807 and then snap into place, and yet of plastic material which is frangible and fracturable so that the tab holding the appropriate roof panels can move longitudinally of the cross-piece 401, or the like, under thermal stresses after the initial installation. Thus, the centering structures are expendable once the initial installation of the roof panels has been completed.

Figure 22:
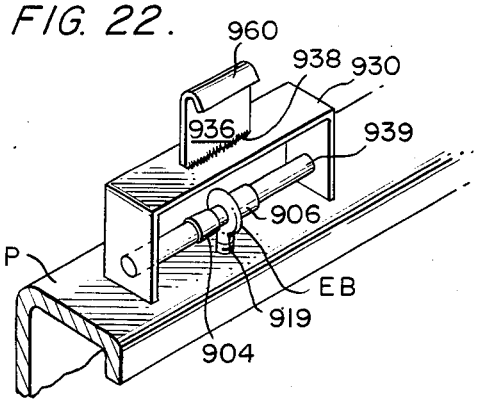
FIG. 22 is another embodiment of the clip assembly.

FIG. 22 shows a further alternate embodiment of the clip structure of the present invention. In this embodiment a tab 936 is securely integrally fastened by welding 938 or the like to a yoke 930. A hook 960 for mating with the roof panel edges for the double seaming operation is appropriately provided. The lower portion of yoke 930 is provided with a longitudinal rod or bar 939 integrally secured thereto. An eye-bolt EB is placed upon this rod prior to the integral securement of the rod with the yoke 930. Centering tapes 904, 906, or snap-on centering structure similar to 804 of FIG. 21, but of more rounded configuration, can likewise be used. During initial installation the eye-bolt EB is appropriately inserted through an aperture 919 in the purlin and secured to the other side by locknuts, washers and the like. Thus, the yoke 930 is slidably secured on top of purlin P. Thus, during thermal expansion and contraction, the roof panels as held by the tab 936 can effect a sliding movement of the entire tab and yoke assembly including rod 939 along the inner circumference of eyebolt EB.

The various embodiments of the present invention all preferably use tabs of stainless steel material for corrosion resistance, and even more importantly, for the inherent thinness thereof so that a very tight and permanent water seal will be effected by the double seaming installation process. Since the tabs of the preferred embodiment, i.e., the triangular cross-piece configuration with centering structure like shown in FIGS. 12–16 and 21, are wrapped around the triangular cross-piece, the overall installed construction is very strong compared to previous known devices. For example, with a $\frac{3}{8}''$ tab of 0.017″ thick stainless steel and using the triangular cross-piece, a 1,500 lb. load was successfully withstood during a laboratory test. In addition, the preferred embodiments will permit a plus or minus $1\frac{1}{4}''$ thermal movement for large 500′ wide buildings. Also, a single fastener, i.e., either self-tapping screws F or eye-bolt EB, will secure the clip and yoke structure to the support purlins.

The overall design is very small and compact and yet extremely strong. The self-destruct centering structure, including all of the various embodiments disclosed, will aid in initial installation of the tab, clip and yoke by maintaining the tab in approximately the center position of the yoke. However, once the initial installation has been completed, then the self-centering structures can be destroyed to permit the required and necessary thermal expansion of the roof panels so that they will not buckle or rip apart the double seam attachment.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

We claim:

1. A clip unit for attaching roof panels to a building structural element comprising:

a base, said base having a building structural element contacting portion and a plurality of side elements connected to said contacting portion;

a cross-piece mounted on said base side elements to extend across said base;

a one-piece tab element slidably mounted on said cross-piece, said tab element including an elongate body, a pair of first portions each extending outwardly from one end of said body at an angle with respect to said body, and a pair of second portions each extending outwardly from one end of each first portion, said first portions being angled with respect to said body to cross over each other when said body is folded back over itself to be bent around or encircle said cross-piece, said second portions being angled with respect to said first portions to extend away from said cross-piece in a common direction and to be spaced from each other when said tab body is bent around or encircles said cross-piece, said tab element further including means for gripping a panel to attach that panel to said base; and a tab position maintaining means on said cross-piece for maintaining said tab in a desired position during panel installation.

2. The clip unit defined in claim 1 wherein said cross-piece is unitary with said base so that said base and said cross-piece are one piece.

3. The clip unit defined in claim 2 wherein said base is I-shaped.

4. The clip unit defined in claim 1 wherein said cross-piece includes an elongate body, said body being slidably received in slots defined in said base side elements.

5. The clip unit defined in claim 1 or 4 wherein said elongate body is triangular in transverse cross-sectional shape.

6. The clip unit defined in claim 1, 2 or 4 wherein said cross-piece is oblong in transverse cross-sectional shape.

7. The clip unit defined in claim 1 wherein said tab position maintaining means includes a sleeve of frangible material

8. The clip unit defined in claim 1 further including fastening means for attaching said base to a building structural element.

9. The clip unit defined in claim 1 wherein said base includes panel supporting aprons attached to said side elements.

10. The clip unit defined in claim 1 wherein said base is yoke shaped.

11. The clip unit defined in claim 1 further including panel supporting means on said base.

12. The clip unit defined in claim 11 wherein said panel supporting means include a pair of aprons having turned down flanges, and each apron being at an angle of 5° to 10° from the horizontal.

13. A clip unit comprising:

a base having a pair of side elements extending therefrom;

a cross-piece supported by said side elements;

means for attaching the base to one of a building structural element and a pair of adjacent roof panels;

further means for slidably affixing the other of said building structural element and pair of adjacent roof panels to the base;

said means for attaching the base to one of a building structural element and a pair of adjacent roof panels including an aperture in said base for receiving a fastener for affixing the base to said building structural element; and said further means for slidably affixing the other of said building structural element and pair of adjacent roof panels to the base including a slidable tab looped around said cross-piece, the ends of the tab being interfolded with a locking seam between said two roof panels.

14. A clip unit as set forth in claim 13, further including centering means for said tab for maintaining said tab in approximately a central position during panel installation, but which is fracturable to permit tab movement after panel installation to compensate for thermal stresses of said roof panels.

15. A clip unit as set forth in claim 14, wherein said tab centering means includes structure made of frangible material for permitting fracture thereof during tab movement under thermal stress.

16. A clip unit as set forth in claim 15, wherein said frangible material is in the form of a pair of snap-on clips which can be placed upon said cross-piece on either side of said tab.

17. A building construction attachment device comprising: a yoke having a building structural element contacting portion and a pair of side elements integral therewith and extending from either side of said portion, said side elements provided with aprons extending at approximately 85° to 90° therefrom so as to provide said aprons with a slight downward taper from the horizontal of approximately 5° to 10° so that the outer ends thereof will not gouge or scrape roof panels as resting thereupon, slots provided in said pair of side elements, a cross-piece slidably mounted within said slots which is of complementary shape thereto, means provided for affixing said cross-piece within said slots after assembly so said cross-piece cannot move, and a tab element slidably mounted on said cross-piece and looped thereabout, means provided for maintaining said looped tab element in said formed arrangement, and centering means associated with said tab element mounted on said cross-piece for maintaining said tab in a desired centered position during initial panel installation.

18. A building construction attachment device as set forth in claim 17, wherein said cross-piece is of triangular cross-section, and said means for affixing said cross-piece within the slots of said side elements is effected by pinching or swaging of the ends of said cross-piece.

19. A plurality of tabs as set forth in claim 18, said tabs being stamped from a single piece of non-corrosive material, said piece of material being pre-inscribed with a pattern indicating the plurality of tabs shaped as above described, and the pattern being such that a minimum amount of material is wasted.

20. A tab as set forth in claim 18, wherein side extensions are provided on each tab to hold same together after looping over said support member upon which said tab can slide.

21. A building construction attachment device as set forth in claim 17, wherein said cross-piece is of oval configuration, and the ends thereof are deformed so as to affix the same within the slots of said side elements.

22. A building construction attachment device as set forth in claim 17, wherein said cross-piece is coated with a layer of lubricating material for increased ease of slidability of the tab as slidably mounted thereon.

23. A tab for use with a building construction clip comprising: a main body portion, a pair of first portions each extending outwardly from one end of said body at an angle with respect to said body, a pair of second portions each extending outwardly from one end of each first portion, said first portions being angled with respect to said body to cross over each other when said body has been folded back over itself after being bent around a support member upon which said tab can be slidably mounted, said second portions being angled with respect to said first portions to extend away from said support member in a common direction but spaced from each other when said tab body is formed as indicated.

24. A clip unit for use during building construction comprising: a base for attachment to a building roof support purlin; means integral with said base for supporting adjacent complementary edges of roof panels thereon with minimal contact for maximum reduction of heat loss therethrough; a cross-piece mounted on said base; and means slidably arranged on said cross-piece for attachment to said edges of said roof panels for positively securing same to said clip unit; said means slidably arranged on said cross-piece comprising a tab of metal, said tab being provided with further means for maintaining a formed bent shape around said cross-piece; all of the aforesaid together with centering means on said cross-piece closely adjacent said tab which is made of frangible material so that said tab will be maintained in centered position during initial installation of the clip unit and yet can fracture to allow desirable thermal expansion and contraction of the roof panels being supported and held thereby during thermal changes thereof.

25. The clip unit as defined in claim 24, furthermore together with lubricating material on said cross-piece and/or tab in addition to said centering means for permitting ease of movement of said tab after said frangible material of the centering means has been fractured.

26. A clip unit for use during building construction comprising: a base for attachment to a building roof support purlin; means integral with said base for supporting adjacent complementary edges of roof panels thereon with minimal contact for maximum reduction of heat loss therethrough; a cross-piece mounted on said base; and means slidably arranged on said cross-piece for attachment to said edges of said roof panels for positively securing same to said clip unit; and wherein said base has a concave bottom for maximum stability of said clip when used on burred holes or a curved purlin surface.

* * * * *

UNITED STATES PATENT AND TRADEMARK OFFICE

CERTIFICATE OF CORRECTION

PATENT NO. : 4,543,760

DATED : October 1, 1985

INVENTOR(S) : W. DAVID BARKER, RAYMOND K. HEISEY, JR, ARTURO C. MARIANO and WAYNE EVANS It is certified that error appears in the above-identified patent and that said Letters Patent is hereby corrected as shown below:

Please correct the Inventive Entity on this patent to include the name of

WAYNE EVANS, Laurinburg, North Carolina

Signed and Sealed this

*First* Day of *July 1986*

[SEAL]

*Attest:*

DONALD J. QUIGG

*Attesting Officer*

*Commissioner of Patents and Trademarks*